United States Patent [19]

Anicich et al.

[11] 4,206,383

[45] Jun. 3, 1980

[54] MINIATURE CYCLOTRON RESONANCE ION SOURCE USING SMALL PERMANENT MAGNET

[75] Inventors: Vincent G. Anicich, Sunland; Wesley T. Huntress, Jr., Sierra Madre, both of Calif.

[73] Assignee: California Institute of Technology, Pasadena, Calif.

[21] Appl. No.: 940,970

[22] Filed: Sep. 11, 1978

[51] Int. Cl.[2] ..... H01J 1/50; H01J 27/00; H05H 1/00

[52] U.S. Cl. ..... 313/362; 250/427; 313/156; 313/363

[58] Field of Search ..... 313/362, 156, 363, 359; 250/427

[56] References Cited

U.S. PATENT DOCUMENTS

| | | | |
|---|---|---|---|
| 2,499,320 | 2/1950 | Loevinger | 313/359 |
| 2,627,034 | 1/1953 | Washburn et al. | 313/362 X |
| 2,743,370 | 4/1956 | McLaren et al. | 313/362 X |
| 3,281,617 | 10/1966 | Wood | 313/363 X |
| 3,283,193 | 11/1966 | Ellison | 313/362 |
| 3,502,863 | 3/1970 | Tsuyama et al. | 250/427 |
| 3,924,134 | 12/1975 | Uman et al. | 313/362 X |

*Primary Examiner*—Palmer C. Demeo

*Attorney, Agent, or Firm*—Freilich, Hornbaker, Wasserman, Rosen & Fernandez

[57] ABSTRACT

An ion source using the cyclotron resonance principle is provided using a miniaturized ion source device in an air gap of a small permanent magnet with a substantially uniform field in the air gap of about 0.5 inch. The device and permanent magnet are placed in an enclosure which is maintained at a high vacuum (typically $10^{-7}$ torr) into which a sample gas can be introduced. The ion-beam end of the device is placed very close to an aperture through which an ion beam can exit into apparatus for an experiment.

8 Claims, 4 Drawing Figures

MINIATURE CYCLOTRON RESONANCE ION SOURCE USING SMALL PERMANENT MAGNET

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; U.S.C. 2457).

BACKGROUND OF THE INVENTION

This invention relates to an ion cyclotron resonance mass spectrometer and more particularly to an improved cyclotron resonance ion source.

The ion cyclotron resonance spectrometer has come into widespread use for the study of ion-molecule reactions. With that has come considerable development in apparatus and techniques for use in such a spectrometer. For a comprehensive review of developments, see J. L. Beauchamp, "Ion Cyclotron Resonance Spectroscopy" Annual Review of Physical Chemistry, Vol. 22, pp 527–561 (1971). There the general basis for ion cyclotron resonance spectrometry is succinctly stated to be motion of a free charged particle in a uniform magnetic field, H. The motion is constrained to a circular orbit of angular frequency, $W_c$, in a plane normal to H and is unrestricted parallel to H. When an alternating field at radio frequency is applied normal to H, absorption of energy by the ions can be observed as a decrease in total ion current or as a direct power absorption when using a marginal oscillator detector.

One problem, to which the present invention is addressed is coupling the ion cyclotron resonance experiment to a non-magnetic experiment or an experiment using a different magnetic field. Prior art cyclotron resonance mass spectrometers were relatively large, heavy and expensive. Typically, the air gap in the magnet is approximately two inches, thus requiring a large electromagnet consuming a relatively large amount of electric power. The problems of such a large electromagnet are then compounded by the difficulty of coupling the ion source in such a large electromagnet to any ion optics, primarily because of the large volume magnetic field. The large volume has the disadvantage of larger residual magnetic fields at several inches distance from the cyclotron experiment.

OBJECTS AND SUMMARY OF THE INVENTION

An object of this invention is to provide an ion source that is capable of being coupled directly from an ion beam port of the source into ion optics.

These and other objects of the invention are achieved by using a permanent magnet with a narrow gap (approximately 0.5 inches) and a field shaped to be of approximately uniform strength across a predetermined length to the edges of the gap. A cyclotron resonance ion source is then placed in the narrow gap with its output beam exiting at one end of the gap and its sample gas entering generally at the other edge of the shaped magnetic field. An enclosure for the permanent magnet and ion source is provided with an aperture at the edge of the shaped magnetic field so closely spaced that the ion beam exiting the ion source passes directly into ion optics. The enclosure is provided with a gas inlet control valve at one end and a gas outlet to a high vacuum pump for reducing residual gas impurities to less than $10^{-7}$ torr.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
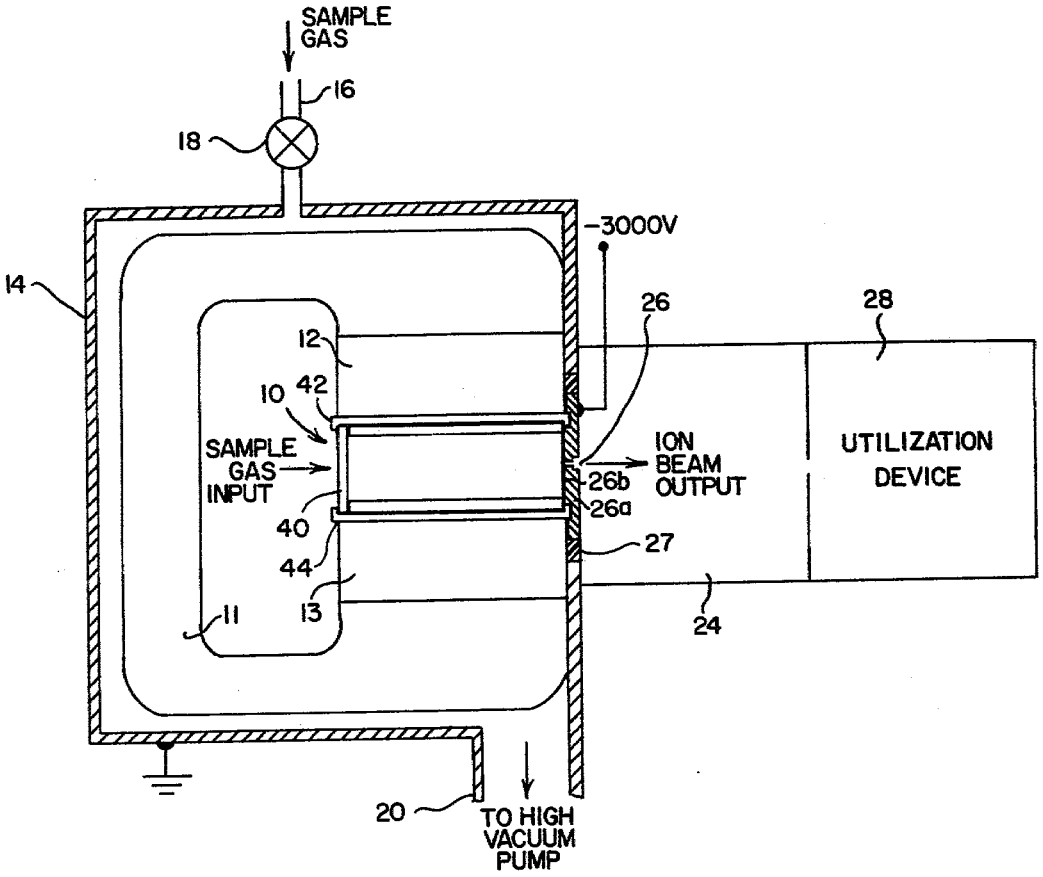
FIG. 1 is a schematic diagram of the present invention.

Referring now to FIG. 1 of the drawings, a miniaturized ion source device 10 is positioned in the air gap of a C-shaped magnet comprised of a yoke 11 and ceramic (rare earth) magnets 12 and 13 in a vacuum enclosure 14 of monmagnetic material having an inlet 16 with a control valve 18 and an outlet 20, which may also have a control valve and which is connected to a high vacuum. In operation as a mass spectrometer, a gas to be analyzed is allowed to flow through the valve 18 into the enclosure 14. Most of the gas then passes out through the outlet 20.

The vacuum enclosure is maintained at an equilibrium pressure of the added gas which is ionized by an electron beam in the presence of the magnetic field H of substantially uniform flux density as will be described more fully with reference to FIG. 4. Ions are formed by impact of electrons generated from a hot filament 22 (FIG. 2) so that motion of the free ions in a plane perpendicular to the field H is constrained to a circular path with the cyclotron resonance frequency $$W_c = qH/mc,$$

where q is the charge of the gas particle, H the magnetic field strength, m the mass of the gas particle, and c the speed of light. The result is an ion beam which exits the ion source device 10 and passes directly into ion optics 24 (FIG. 1) through an aperture 26 in a plate 26a in the enclosure 14. This aperture is electrically isolated from the enclosure, which is maintained at 0 volts, because the device 10 and magnet 11 can be biased from ground to several thousand volts, using a ring 27 of dielectric material around the aperture plate separating it from the enclosure. The ion optics focuses the ion beam into a utilization device 28, such as a mass spectrometer. Ion beam energies are variable from a thermal velocity distribution to several thousand electron volts.

The ion optics and utilization device are conventional in design and operation except that the ion optics are placed next to the enclosure directly over the aperture 26 for the ion beam. The ion source device 10 is also somewhat conventional in design and operation, but in accordance with the present invention, the ion source device is made two orders of magnitude smaller in volume and weight than prior art ion source device using the cyclotron resonance principle. Typically, the air gap in the magnet required by the prior art devices is approximately 2 inches, requiring a large electromagnet consuming a relatively large amount of electric power, and greatly complicating the apparatus required to couple the ion beam to ion optics for the utilization device. The ion source device of the present invention is miniaturized to a degree that reduces the air gap in the magnet to about 0.5 inches, or less, so that a small permanent magnet can be used in place of the large electromagnet.

Figure 2:
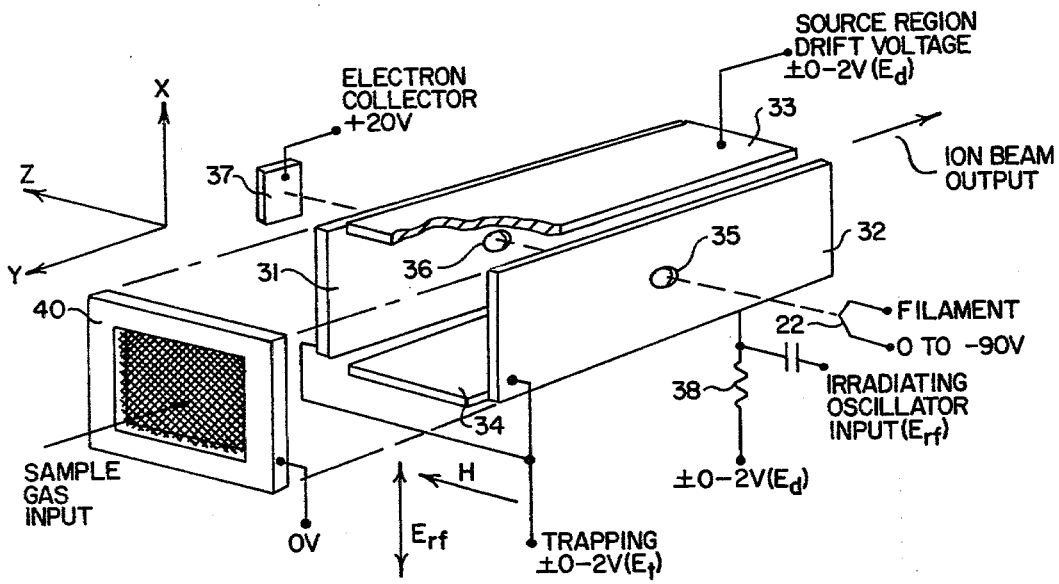
FIG. 2 is a perspective schematic diagram illustrating functional operation of a miniaturized ion source device in the present invention shown in FIG. 1.
Figure 3:
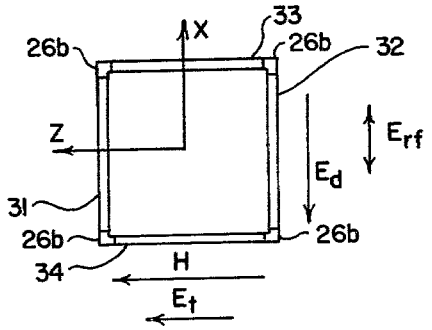
FIG. 3 is an end view of the device in FIG. 2 with arrows to show the direction of the magnetic and electric fields.
Figure 4:
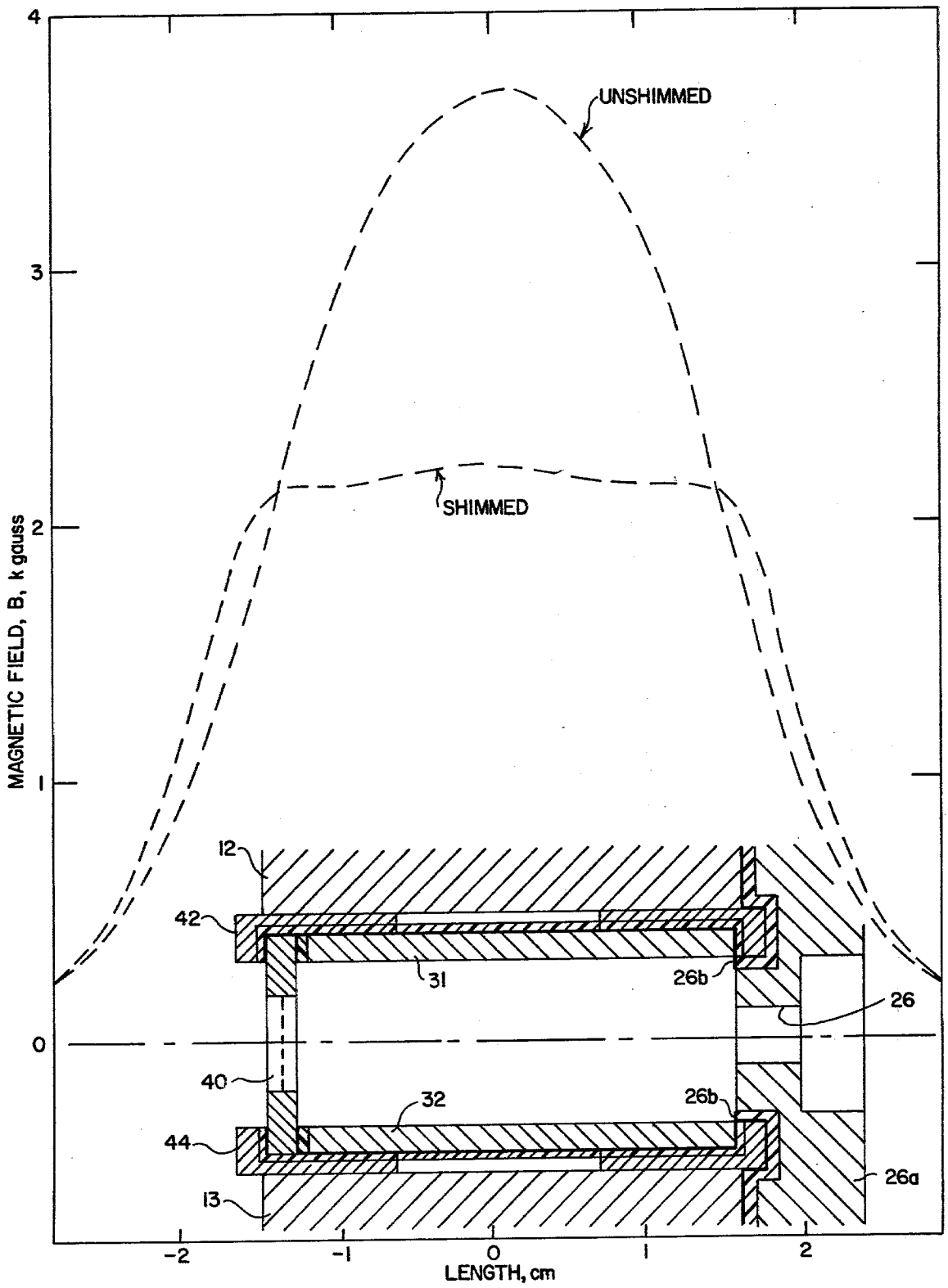
FIG. 4 is a side view of the device in FIG. 2 with dotted line curves to show the shaped magnetic field provided in accordance with the present invention as compared with the typical magnetic field of the unshimmed magnet.

Referring to FIG. 2, the miniaturized ion source includes six non-magnetic plates, side plates 31–34, a front end plate 40, and the aperture plate 26 (not shown in FIG. 2 but shown in FIGS. 1 and 4). These plates are electrically isolated from each other as schematically indicated in the end view of FIG. 3, and in FIG. 4, by dielectric material **26*b***.

The vertical side plates, 31 and 32, have aligned holes 35 and 36 for electrons to pass from the hot filament 22 to an electron collector 37. The collector is maintained at a positive potential, such as 20 V, while the filament is maintained at a negative potential (0 to −90 V). This potential gradient between the filament and collector produces a beam of electrons that impact the molecules of gas between the vertical plates, thereby ionizing the molecules. The vertical side plates are maintained at a very low positive potential (0 to 2 V) in order to collect electrons not passing through the holes 35 and 36 and trap the ions formed. The upper side plate 33 is maintained at a very low positive potential (0 to 2 V) while a low voltage AC signal is applied to the lower side plate 34 using a bias resistor 38 connected to a very low negative potential (0 to 2 V). The AC signal is at some radio frequency, typically 307 kHz.

Positioned over the input end of the ion source device is an end plate 40 comprised of a screen in a frame maintained at zero volts. Its function is to allow unionized molecules to enter the device 10 and to prevent ionized molecules from exiting the device except through the output end. In that regard it should be noted that although not shown, the space between the plates along their edge is sealed with dielectric material, such as an epoxy, which also serves to support the plates in position relative to each other.

The motion of the ions formed by electron impact in the magnetic field is constrained to a circular path of angular frequency equal to the cyclotron resonance frequency $W_c$, which is independent of the velocity of the ions in a direction perpendicular to the magnetic field. The electric field of the AC signal applied perpendicular to the magnetic field can be controlled in amplitude to produce a linear mass spectrum by maintaining the magnetic field constant and scanning the AC frequency. For that purpose, the permanent magnet is shimmed (shaped) to produce a uniform field over the length of the ion source device that is shown in FIG. 4. A typical unshimmed field is also shown in FIG. 4 for comparison. The shims required are shown in FIG. 4 as soft iron caps, 42 and 44 which fit between the magnets 12 and 13 and the upper and lower plates 33 and 34 of the ion source device, each with a hole over about ⅓ its length and width. The substantially rectangular hole is provided with rounded corners so that the hole is substantially rounded at the ends. The particular shape of the holes in the shims is selected to provide an airgap at the central region to reduce the magnetic field as shown in FIG. 4 over the length of the device 10. The shape of the magnetic field over the width of the device is similarly shaped by this shimming arrangement. Other shimming arrangements for so shaping the magnetic field will, of course, occur to others skilled in the art.

In summary of operation, the miniature ion source 10 of FIG. 1 uses the cyclotron resonance principle, as in the prior art, but uses a permanent uniform magnetic field. Relatively low energy ions are produced by means of electron impact (bombardment with electrons generated by a hot filament) in the device chamber. The uniform magnetic field causes the ions to move in a circular motion (due to the cyclotron principle), and an electrostatic field which causes them to exit the chamber as an ion beam. For use as a mass spectrometer, the AC field frequency is scanned by the irradiating oscillator input $E_{rf}$. It can also be used for studying ion-molecule reactions by ion cyclotron resonance methods by using the device as an ion source for either a quadrapole mass spectrometer or magnetic sector mass spectrometer. In this way the ion source device can also serve as a low pressure chemical ionization source.

What has been disclosed is a small, low-cost ion source using the cyclotron resonance principle. Such a source may be used in a variety of ways, with or without ion optics. Examples of application include a conventional mass spectrometer having either a quadrapole or magnetic sector, and as a low pressure chemical ionization. Consequently, although an exemplary embodiment of the invention has been described and illustrated herein, it is recognized that modifications may readily occur to those skilled in the art, particularly as to use. Consequently, it is intended that the claims be interpreted to cover such modifications and equivalents.

What is claimed is:

1. An ion beam source using the cyclotron resonance principle comprising an ion source device, said device having four electrically isolated electrode plates defining a channel having one screened end through which sample gas molecules enter, and an open end opposite said one end through which a beam of ionized molecules exit, said device including electron bombardment means for ionizing said gas molecules as they enter said channel at said one end, and means for forming said ion beam in accordance with said cyclotron resonance principle, said means comprising a magnet having a small gap between pole faces extending over the length of said device, said magnet being made to provide a substantially uniform flux density throughout substantially the full length of said device, with a rapid fall off of magnetic flux density at the exit edge of said device, and an enclosure for said magnet and ion source device, said enclosure having an inlet for said gas, an outlet for said gas, and an aperture for said beam out of said device, said open end of said device through which said beam exits being placed directly in front of said aperture whereby said ion beam exiting said device passes directly out of said enclosure.

2. An ion source device for providing ions to an apparatus adjacent said device using the cyclotron resonance principle, said device having four electrically isolated electrode plates defining a channel, said channel being open at one end to receive sample gas molecules, and open at the other end opposite said one end for providing an ion beam out of said channel into said apparatus, an improvement comprising magnetic means for providing a substantially uniform flux density the full length of said device from said one end to said opposite end, with a rapid fall off of magnetic flux density at the ends of said device, means for electron bombardment of said sample gas in order to ionize said sample gas, and an enclosure for said ion source device and said magnetic means into which a sample gas can be introduced, said enclosure having a wall against said device at said other open end with an aperture in said wall opposite the channel opening at said other open end for said ion beam to pass into said apparatus for an experiment.

3. The combination of claim 2 wherein said means for providing a substantially uniform field is comprised of a C-shaped permanent magnet having opposing pole faces extending just over the length of said device with magnetic shims between said pole faces and said device to shape the magnetic field to be substantially uniform over the length of said device and with rapid fall off at the ends of said device.

4. The combination of claim 3 wherein the gap between said pole faces is about 0.5 inches and the length of ion source device is about three times the gap.

5. The combination of claim 4 wherein said ion source device is comprised of said four electrically isolated electrode plates arranged to provide a rectangular sample gas opening at said one end and an ion beam exit at said other end, means for electron bombardment of sample gas molecules passing through said one end, thereby to ionize molecules which move in a circular motion in accordance with said cyclotron principle, and means for applying voltages to said plates for producing along the length of said device an electrostatic field which causes them to exit through said other end as an ion beam.

6. The combination of claim 4 wherein said C-shaped magnet is comprised of a soft iron yoke with a wide gap and two ceramic magnet blocks, one on each side of said wide gap with shims to close the gap over said ion source device and provide said uniform magnetic field.

7. A miniature cyclotron resonance ion beam source having an ion source device with an input end and an ion exit end, said device comprising a permanent magnet having a small gap of about 0.5 inches and a substantially uniform magnetic flux density over the length of said gap with rapid drop off of magnetic flux density at the ion exit end of said ion source device, a sample gas enclosure having a wall with an aperture over said exit end at a point before said magnetic flux drops off, and means for electron bombardment of gas molecules entering said device at said input end to ionize gas molecules entering at said input end, and means for producing a uniform electrostatic field across the length of said device to cause ions, which move in a circular motion in accordance with the cyclotron principle, to exit said device and enclosure through said aperture.

8. An ion source device as defined in claim 7 wherein said permanent magnet is comprised of a soft iron C-shaped yoke with a wide gap and two ceramic magnet blocks, one on each side of said wide gap with shims to close the gap over said ion source device and provide said uniform magnetic field.

* * * * *